US006484477B1

(12) United States Patent
Bernhard

(10) Patent No.: US 6,484,477 B1
(45) Date of Patent: Nov. 26, 2002

(54) CAPPING MACHINE FOR CAPPING AND CLOSING CONTAINERS, AND A METHOD FOR CLOSING CONTAINERS

(75) Inventor: Herbert Bernhard, Wolfsheim (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 41 days.

(21) Appl. No.: 09/759,985

(22) Filed: Jan. 12, 2001

(30) Foreign Application Priority Data

Jan. 14, 2000 (DE) ..... 100 01 200

(51) Int. Cl.[7] ..... B67B 1/03
(52) U.S. Cl. ..... 53/426; 53/137.1
(58) Field of Search ..... 53/426, 425, 467, 53/130.1, 131.1, 133.1, 137.1, 281, 284.5, 287, 376.3; 422/99

*Primary Examiner*—John Paradiso

(74) *Attorney, Agent, or Firm*—Nils H. Ljungman & Associates

(57) ABSTRACT

Method and device to close containers with a closure that contains a reclosable drinking opening and a protective cap to cover such a drinking opening. Closures of this type for the closure of containers are supplied in the form of a complete unit with a pressed-on protective cap and a closed drinking opening, and in this condition they are cleaned from inside, preferably prior to the actual closing. The closure is then placed on the bottle. During the cleaning and/or sterilization process, it is unavoidable that traces of fluid will remain in the internal structure of the closure, which is constructed of a number of different parts. Such fluid traces represent a major disadvantage, in particular in the beverage industry, and are therefore undesirable. The invention teaches a method of the type described above in which, prior to the closing process, the closures are subjected to a cleaning with the drink opening opened, and then the opened drinking opening is placed on the mouth of the container, during which process the drinking opening is closed, and then the protective caps are placed on the closures.

20 Claims, 3 Drawing Sheets

CAPPING MACHINE FOR CAPPING AND CLOSING CONTAINERS, AND A METHOD FOR CLOSING CONTAINERS

BACKGROUND OF THE INVENTION

1. Field of the Invention

This invention relates to a capping machine for capping containers, as well as a method for capping containers. The invention also relates to a method of cleaning and attaching a reclosable cap for containers, which cap is openable and reclosable using a push-pull method and has a protective cover.

This invention further relates to a method for closing containers with a closure that contains a reclosable drinking opening and a protective cap to cover such a drinking opening, as well as to a device to carry out this method.

2. Background of the Invention

Closures of this type for the closure of containers are supplied in the form of a complete unit with a pressed-on protective cap and a closed drinking opening, and in this condition they are cleaned from inside, preferably prior to the actual closing of the container on which they are to be installed. The closure is then placed on the bottle. During the cleaning and/or sterilization process, it is unavoidable that traces of fluid will remain in the internal structure of the closure, which is constructed of a number of different parts. Such fluid traces represent a major disadvantage, in particular in the beverage industry, and are therefore undesirable.

The closures are generally in the form of a push-pull cap, which cap may be pushed shut to close the opening to prevent liquid from escaping from the container. The cap may also be pulled open by sliding the outer portion of the cap axially to provide an opening to permit liquid to exit the container. A separate cap is often placed about the exterior of the push-pull cap to provide protection from dust and other foreign materials. This separate cap is removed prior to use by a user, but often can be replaced by the user to provide a further protective function.

OBJECT OF THE INVENTION

The object of the invention is to indicate an improved method for the cleaning and application of such closures.

A further object of the invention is to provide machinery to accomplish the above method.

SUMMARY OF THE INVENTION

The invention teaches a method of the type described above in which, prior to the closing process, the closures are subjected to a cleaning with the drink opening opened, and then the opened drinking opening is placed on the mouth of the container, during which process the drinking opening is closed, and then the protective caps are placed on the closures.

Additional characteristics of the invention are disclosed in the features of the invention herein.

The method claimed by the invention essentially guarantees an improved and perfect cleaning of such closures. The closures are supplied in two parts as a closure which includes a separate protective cap, whereby the separate drinking opening is opened. In this condition, the closure is appropriately subjected to a cleaning process with the drinking opening facing down, whereby the cleaning fluid introduced through the interior or the corresponding sterilization agent can escape downward. A separate cleaning of the protective caps also takes place.

In at least one other possible embodiment, the method may not produce a perfect cleaning, but rather a substantially perfect cleaning that cleans all or almost all of the closure.

Further, in at least one possible embodiment according to the present invention, the closures enter the cleaning process in a substantially vertical position with their openings pointing downward. The cleaning fluid can be sprayed or directed into the open closure by a nozzle or hose system having at least one nozzle. After the initial spraying with cleaning fluid, most of the excess fluid can drip out of the opening. The closure can then be transported through a drying process, in which a blower or other type system is activated to dry the closures and remove any remaining cleaning fluid. The closures can then be transported into the capping machine where they are closed and substantially simultaneously attached to a container. The outer protective cap can then be attached.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiment that is illustrated in the accompanying drawings.

DESCRIPTION OF THE PREFERRED EMBODIMENT

Figure 5:
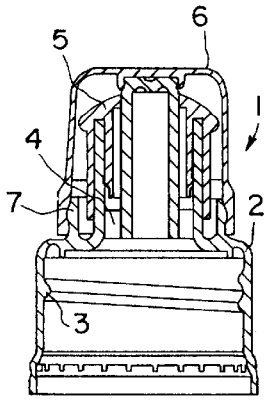
FIG. 5 shows a complete closure.

As shown on the exemplary embodiment illustrated in FIG. 5, the complete closure 1, which in this case is realized in the form of a screw closure by way of example, consists of the closure part 2 with the screw thread 3 and a ring-shaped drinking opening 4 that is realized in its upper end surface. This drinking opening 4 is closed by a closure 5 that can be moved in the axial direction into the open position. To protect this closure 5, there is an additional protective cap 6 which is held fast in a locking connection 7. The invention teaches that for the closing of containers, bottles 8 and similar items, a closure 1 of this type is fed separately from the protective cap 6, and with the drinking opening open, to the machine that closes these bottles 8.

Figure 1:
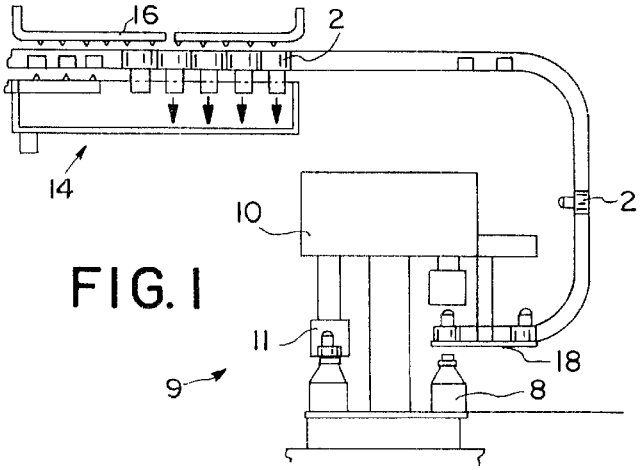
FIG. 1 is a simplified illustration of a closing machine in a side view.
Figure 1A:
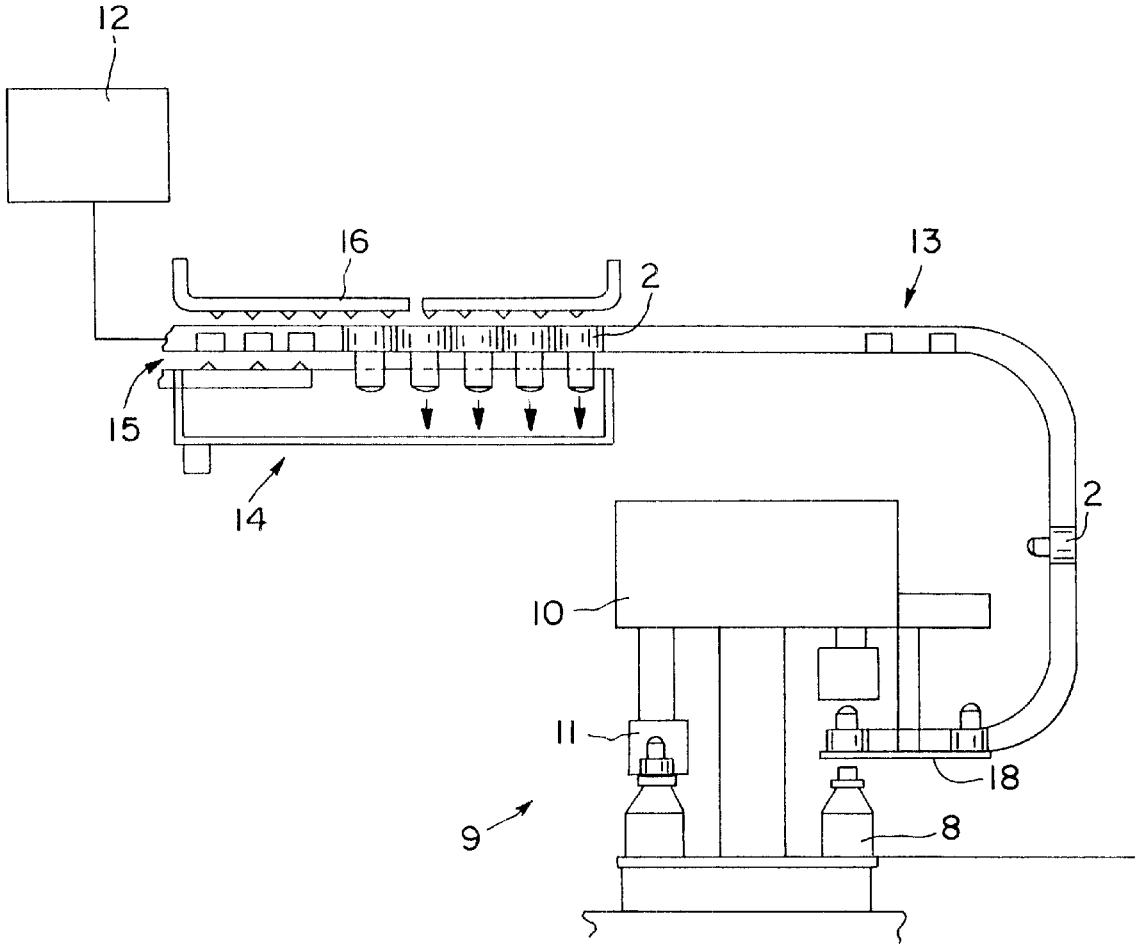
FIG. 1A is a view of the closing machine in FIG. 1 with additional features.

In the exemplary embodiment illustrated in FIG. 1, the system used to carry out the method consists of a closing machine 9 with a rotor 10, on which the individually circulating capping heads 11 are located. The closures or the closure parts 2 with the opened drink opening 4 are delivered to the transfer position 13 on the closing machine by means of a feed device 12 (see FIG. 1A), whereby they are first transported with the drinking opening downward and the actual screw closure opening facing upward in front of the transfer point 13 through a cleaning bath 14. The separately fed protective caps 6 are likewise guided in an additional track 15 through the cleaning bath 14 or another suitable cleaning device. This cleaning device can also consist of rows of spray nozzles 16. This cleaning can be done using water, sterile liquid, steam or similar cleaning agents. The closures cleaned in this manner are then input into the closing machine.

Figure 1B:
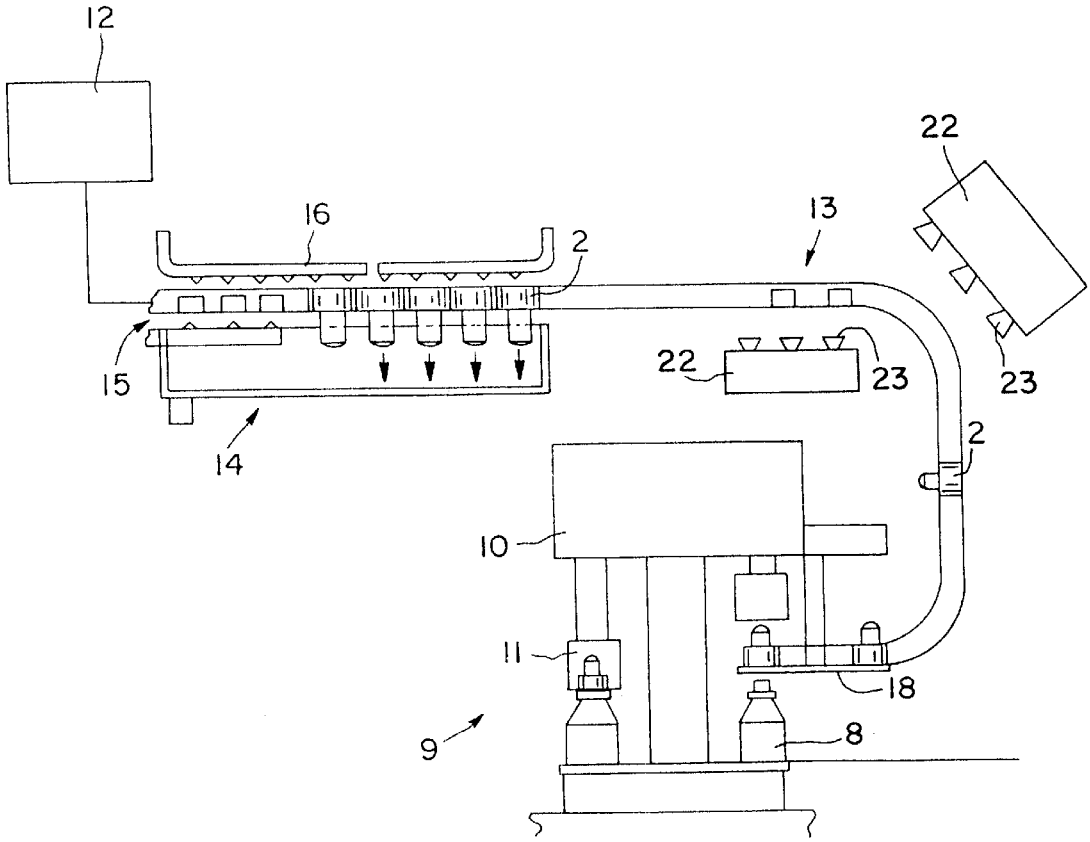
FIG. 1B is a view of the closing machine in FIG. 1A with optional drying device.

In at least one additional embodiment, a dryer device 22 is provided to further dry the screw closures 2 and/or protective caps 6 to remove any remaining cleaning agent prior to the attachment of the closures 2 or caps 6 to the bottle 8. The dryer device 22 has, in the embodiment shown in FIG. 1B, a set of air blowers 23 to blow dry the screw closures 2 and/or the protective caps 6.

Figure 2:
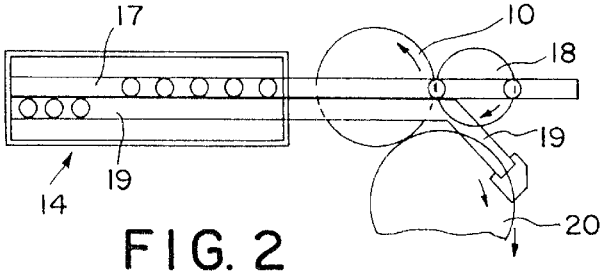
FIG. 2 is a plan view of such a closing machine with a feed for the protective caps for the closed containers.

In the exemplary embodiment illustrated in FIG. 2, there is a transport track 17 for the opened screw closures 2 which are fed by means of a delivery device 18 to the closer turntable or closing head 11. The latter device descends onto the bottles 8 and screws the closure 2 onto the mouth of the bottle. The closing head 11 has means 21 which, during this process, also automatically close the drinking closure. The bottle closed in this manner is then guided to the additional turntable 20, in which the protective cap 6 is then installed as described above. However, the drinking opening 4 can also be closed as early as in the feed area, after it has been cleaned and before the actual closing process is carried out.

Figure 3:
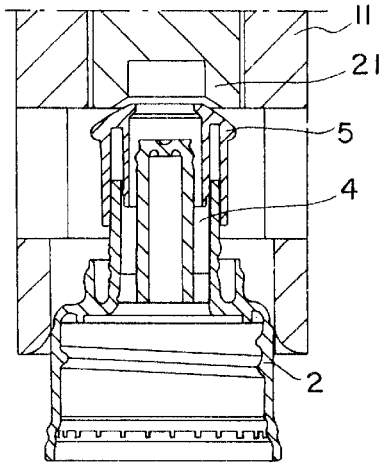
FIG. 3 shows a closing head which has picked up the closure and with the drinking opening still open.
Figure 4:
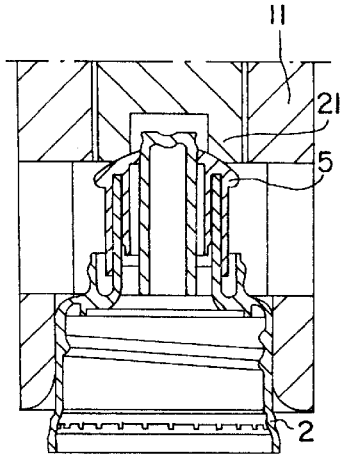
FIG. 4 shows a closing head with the closure and the drinking opening, which has been closed in the meantime.

FIGS. 3–5 show the various stages of the closing and capping of the screw closures 2, which can be a push-pull type of closure. As stated above, the screw closures 2 may enter the closing machine 9 in the open position, i.e. with the closure part 5 extended axially. The closing head 11 produces a driving force to screw the screw closures 2 onto a bottle 8. As the closing head 11 screws the screw closure 2 onto the bottle 8, the contacting portion 21 of the closing head 11 comes into contact with the top surface of the closure part 5. As the closing head 11 drives downward to screw on the screw closures 2, the contacting portion 21 pushes down the closure part 5, thereby closing the opening 4, as seen in FIG. 4. The protective cap 6 can then be attached to the screw closure 2 at the locking connection 7, as seen in FIG. 5.

The protective caps 6 are transported and cleaned if necessary on a line 19 that runs parallel to the closing system described above. The protective caps are then deposited in an additional turntable 20 on the closures 2 that have already been screwed onto the bottles, or they can also be picked up by the turntable and pressed into place.

In addition, an example of a push-pull cap or closure with a protective dust cap similar to the type described above is manufactured under the name "Sports-Lok" by Alcoa Closure Systems International, Inc., 6625 Network Way—Suite 200, Indianapolis, Ind. 46728, which company is a subsidiary of Alcoa. Such a cap is used as a closure system for water or liquids stored in a container. The cap is especially used in sports bottles to permit the user easy access to the beverage contained therein, as well as the ability to reclose the cap for storage of the beverage until later use. The protective cap has a tamper resistant band that must be broken to access the closure. The protective cap may also be snapped back on after removal to provide further protection. The closure tip is orthodontically designed for the comfort of a user who is drinking from the bottle.

One feature of the invention resides broadly in a method for closing containers with a screw closure that contains a reclosable drinking opening and a protective cap to cover such a drinking opening, characterized by the fact that the closures (2) with the opened drinking opening (4) are subjected to a cleaning prior to the closing process, and then the opened closure (2) is placed on the mouth of the container (8), during which process the drinking opening (4) is closed, and then the protective caps (6) are placed on the closures (2, 5).

Another feature of the invention resides broadly in a method for closing containers characterized by the fact that the closures (2) with the opened drink opening (4) facing downward are subjected to a cleaning bath and are guided into the closing machine (9), during which process the drinking opening (4) is closed.

Yet another feature of the invention resides broadly in a method for closing containers characterized by the fact that the drinking openings (4) are dried after the cleaning process, and are closed prior to being placed on the mouths of the containers.

Still another feature of the invention resides broadly in a method for closing containers characterized by the fact that the drinking openings (4) are closed by the installation of the closure (2) on the container mouth.

A further feature of the invention resides broadly in a closing machine to carry out a method for closing containers characterized by the fact that the closing machine (9) and/or the closing heads (11) are realized with additional means (21) to close the opened drinking opening (5) and with an additional device to install the protective caps (6).

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 100 01 200, filed on Jan. 14, 2000, having inventor Herbert BERNHARD, and DE-OS 100 01 200 and DE-PS 100 01 200, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Some examples of bottle caps which could possibly be utilized or incorporated in at least one possible embodiment of the present invention may be found in the following U.S. Pat. No. 6,059,099, issued to Galbierz on May 9, 2000; U.S. Pat. No. 5,829,638, issued to Lucas, on Nov. 3, 1998; U.S. Pat. No. 5,609,263, issued to Perchepied, on Mar. 11, 1997; U.S. Pat. No. 5,450,882, issued to Cragun, on Sep. 19, 1995; U.S. Pat. No. 5,437,139, issued to Martin, on Aug. 1, 1995; U.S. Pat. No. 5,321,935, issued to Spatz, et al. on Jun. 21, 1994; U.S. Pat. No. 5,255,805, issued to Weiss, et al. on Oct. 26, 1993; U.S. Pat. No. 5,244,106, issued to Takacs, on Sep. 14, 1993; U.S. Pat. No. 5,104,008, issued to Crisci on Apr. 14, 1992; U.S. Pat. No. 4,883,203, issued to Kittscher, on Nov. 28, 1989; U.S. Pat. No. 4,478,242, issued to Bond on Oct. 23, 1984; U.S. Pat. No. 4,476,987, issued to Nolan, on Oct. 16, 1984; U.S. Pat. No. 4,347,879, issued to Blaser, on Sep. 7, 1982.

Some examples of cleaning machines and methods for cleaning used in capping and bottling systems which could possibly be utilized or incorporated in at least one possible embodiment of the present invention may be found in the following U.S. Pat. No. 5,040,354, issued to Ahlers, et al. on Aug. 20, 1991; U.S. Pat. No. 4,304,611, issued to Ellis on Dec. 8, 1981; U.S. Pat. No. 4,167,797, issued to Wilde, et al. on Sep. 18, 1979; and U.S. Pat. No. 4,074,654, issued to Noguchi, et al. on Feb. 21, 1978.

Some examples of methods or machines of cleaning plastics which could possibly be utilized or incorporated in at least one possible embodiment of the present invention may be found in the following U.S. Pat. No. 6,164,034, issued to Roetheli on Dec. 26, 2000; U.S. Pat. No. 6,126, 533, issued to Johnson et al., on Oct. 3, 2000; U.S. Pat. No. 5,407,615, issued to Norville, on Apr. 18, 1995; U.S. Pat. No. 5,376,183, issued to Gatt et al., on Dec. 27, 1994; U.S. Pat. No. 5,313,767, issued to Gentile, on May 24, 1994; U.S. Pat. No. 5,203,359, issued to Fesmire et al., on Apr. 20, 1993; U.S. Pat. No. 5,174,316, issued to Keller et al., on Dec. 29, 1992; U.S. Pat. No. 5,110,055, issued to Teeny, on May 5, 1992; U.S. Pat. No. 4,104,758, issued to Stotler, on Aug 8, 1978.

Some examples of capping machines which could possibly be utilized or incorporated in at least one possible embodiment of the present invention may be found in the following U.S. Pat. No. 6,105,343, issued to Grove et al., on Aug, 22, 2000; U.S. Pat. No. 6,023,910, issued to Lubus et al., on Feb. 15, 2000; U.S. Pat. No. 5,975,321, issued to Luch, on Nov. 2, 1999; U.S. Pat. No. 5,975,320, issued to Bietzer et al., on Nov. 2, 1999; U.S. Pat. No. 5,918,442, issued to Dewees et al., on Jul. 6, 1999; U.S. Pat. No. 5,755,348, issued to Luch et al., on May 26, 1998; U.S. Pat. No. 5,678,718, issued to Morris et al., on Oct. 21, 1997; U.S. Pat. No. 5,634,500, issued to Clüsserath et al., on Jun. 3, 1997.

Some examples of machines for closing caps which could possibly be utilized or incorporated in at least one possible embodiment of the present invention may be found in the following U.S. Pat. No. 6,158,196, issued to Trebbi et al., on Dec. 12, 2000; U.S. Pat. No. 6,023,910, issued to Lubus et al., on Feb. 15, 2000; U.S. Pat. No. 5,662,245, issued to Grant, on Sep. 2, 1997; U.S. Pat. No. 5,070,599, issued to Eitzinger et al, on Dec. 10, 1991; U.S. Pat. No. 4,997,285, issued to Schmidt, on Mar. 5, 1991; U.S. Pat. No. 4,545,412, issued to Gamberini, on Oct. 8, 1985; U.S. Pat. No. 3,944, 106, issued to Lamb, on Mar. 16, 1976.

The following U.S. Patents are hereby incorporated by reference as if set forth in their entirety herein as follows: U.S. Pat. No. 5,813,575, entitled "Touch free push-pull valve with overcap" issued to Glynn et al., on Sep. 29, 1998; U.S. Pat. No. 6,095,375, entitled "Dust cover attachment for push-pull cap" issued to Adams et al., on Aug. 1, 2000; U.S. Pat. No. 5,230,447, entitled "Self-closing push-pull bottle top" issued to Kirk, on Jul. 27, 1997.

The invention as described hereinabove in the context of the preferred embodiments is not to be taken as limited to all of the provided details thereof, since modifications and variations thereof may be made without departing from the spirit and scope of the invention.

What is claimed is:

1. A method for closing beverage containers with a screw-top closure that comprises a reclosable drinking portion and a protective cap to cover said reclosable drinking portion, said method comprising the steps of:

opening said reclosable drinking portion in said screw-top closure;

transporting said screw-top closure into a cleaning position in a cleaning arrangement;

cleaning said screw-top closure with said cleaning arrangement;

transporting said screw-top closure to a capping machine upon completion of said cleaning step;

moving said screw-top closure in said capping machine into a position to be capped onto said beverage container;

moving a beverage container in said capping machine into a position to be capped with said screw-top closure;

screwing said screw-top closure onto said beverage container to close said beverage container;

closing said reclosable drinking portion of said screw-top closure subsequent to screwing said screw-top closure onto said beverage container;

moving said beverage container with said screw-top closure into a position to be further capped with said protective outer cap;

moving said protective outer cap into a position to placed onto said screw-top closure;

placing said protective outer cap onto said screw-top closure to partially surround said reclosable drinking portion of said screw-top closure to protect said reclosable drinking portion from contamination and thus produce a sanitary reclosable drinking portion; and moving the beverage container out of the capping machine.

2. The method for closing beverage containers according to claim 1, wherein said step of transporting said screw-top closure into a cleaning position in a cleaning arrangement further comprises positioning said screw top closure to permit said opened reclosable drinking portion to face downward toward a floor area below the cleaning arrangement.

3. The method for closing beverage containers according to claim 2, wherein said step of cleaning said screw-top closure with said cleaning arrangement further comprises applying a cleaning liquid to said screw-top closure.

4. The method for closing beverage containers according to claim 3, wherein said method further comprises the step of drying said screw-top closure after the application of the cleaning liquid.

5. A method for closing beverage containers with a screw-top closure that comprises a reclosable drinking portion and a protective cap to cover said reclosable drinking portion, said method comprising the steps of:

opening said reclosable drinking portion in said screw-top closure;

transporting said screw-top closure into a cleaning position in a cleaning arrangement;

cleaning said screw-top closure with said cleaning arrangement;

transporting said screw-top closure from said cleaning arrangement to a capping machine;

moving said screw-top closure into a position to cap said beverage container;

moving said beverage container into a position to be capped with said screw-top closure;

placing said screw-top closure onto said beverage container to close said beverage container;

closing said reclosable drinking portion of said screw-top closure;

moving said beverage container with said screw-top closure into a position to be further capped with said protective outer cap;

moving said protective outer cap into a position to placed onto said screw-top closure;

placing said protective outer cap onto said screw-top closure to at least partially surround and protect said reclosable drinking portion of said screw-top closure; and moving the beverage container out of the capping machine.

6. The method for closing beverage containers according to claim 5, wherein said step of transporting said screw-top closure into a cleaning position in a cleaning arrangement further comprises positioning said screw top closure to permit said opened reclosable drinking portion to face downward toward a floor area below the cleaning arrangement.

7. The method for closing beverage containers according to claim 6, wherein said step of cleaning said screw-top closure with said cleaning arrangement further comprises applying a cleaning liquid to said screw-top closure.

8. The method for closing beverage containers according to claim 7, wherein said method further comprises the step of drying said screw-top closure after the application of the cleaning liquid.

9. The method for closing beverage containers according to claim 8, wherein said method further comprises the step of closing said reclosable drinking opening prior to said step of placing said screw-top closure onto said beverage container to close said beverage container.

10. The method for closing beverage containers according to claim 8, wherein said method further comprises the step of closing said reclosable drinking opening during said step of placing said screw-top closure onto said beverage container to close said beverage container.

11. A method for closing containers with a screw closure that contains a reclosable drinking opening and a protective cap to cover such a drinking opening, wherein the closures with the opened drinking opening are subjected to a cleaning prior to the closing process, and then the opened closure is placed on the mouth of the container, during which process the drinking opening is closed, and then the protective caps are placed on the closures.

12. The method as claimed in claim 11, wherein the closures with the opened drink opening facing downward are subjected to a cleaning bath and are guided into the closing machine, during which process the drinking opening is closed.

13. The method as claimed in claim 11, wherein the drinking openings are dried after the cleaning process, and are closed prior to being placed on the mouths of the containers.

14. The method as claimed in claim 11, wherein the drinking openings are closed by the installation of the closure on the container mouth.

15. A beverage container closing machine for closing beverage containers with a screw-top closure having a reclosable drinking portion and a protective cap to cover said reclosable drinking portion, said beverage container closing machine comprising:

an opening device being configured to open said reclosable drinking portion in said screw-top closure;

a cleaning arrangement being configured to clean said screw-top closure;

a first transport arrangement being configured to transport said screw-top closure into a cleaning position to be cleaned by said cleaning arrangement;

a capping machine being configured to cap a beverage container with said screw-top closure;

said first transport arrangement being configured to transport said screw-top closure from said cleaning arrangement to said capping machine;

a second transport arrangement being configured to transport beverage containers to said capping machine;

said capping machine being configured to place said screw-top closure onto said beverage container to close said beverage container;

said capping machine being configured to close-said reclosable drinking portion of said screw-top closure;

said capping machine being configured to place said protective outer cap on said screw-top closure of said beverage container to at least partially surround and protect said reclosable drinking portion of said screw-top closure; and said second transport arrangement being configured to transport said beverage container out of said capping machine.

16. The beverage container closing machine according to claim 15, wherein said cleaning arrangement comprises an application device configured to apply a cleaning liquid to said screw-top closure.

17. The beverage container closing machine according to claim 16, wherein said transport arrangement is configured to dispose said screw-top closure to permit said cleaning liquid to drain from said opened reclosable drinking portion.

18. The beverage container closing machine according to claim 17, further comprising a drying arrangement being configured to dry said screw-top closure after the application of the cleaning liquid.

19. The beverage container closing machine according to claim 18, wherein said capping machine is configured to close said reclosable drinking opening prior to placing said screw-top closure onto said beverage container to close said beverage container.

20. The beverage container closing machine according to claim 18, wherein said capping machine is configured to close said reclosable drinking opening while substantially simultaneously placing said screw-top closure onto said beverage container to close said beverage container.

* * * * *